United States Patent [19]

Verhoeven et al.

[11] Patent Number: 4,696,529

[45] Date of Patent: Sep. 29, 1987

[54] CARD HOLDER

[75] Inventors: Laurentius M. Verhoeven, Veghel; Cornelis G. J. van Nes, Oisterwijk, both of Netherlands

[73] Assignee: E. I. Du Pont de Nemours and Company, Wilmington, Del.

[21] Appl. No.: 830,841

[22] Filed: Feb. 19, 1986

[30] Foreign Application Priority Data

Mar. 1, 1985 [NL] Netherlands ..... 8500587

[51] Int. Cl.[4] ..... H01R 9/09

[52] U.S. Cl. ..... 439/267; 439/325; 439/633

[58] Field of Search ..... 339/74 R, 75 MP, 176 MP, 339/97 C

[56] References Cited

U.S. PATENT DOCUMENTS

| | | | |
|---|---|---|---|
| 3,075,167 | 1/1963 | Kinkaid | 339/176 |
| 3,567,998 | 3/1971 | Ammerman | 339/176 MP |
| 3,611,259 | 10/1971 | Palecek | 339/74 R |
| 3,720,907 | 3/1973 | Asick | 339/176 |
| 3,930,706 | 1/1976 | Obuch et al. | 339/64 |
| 3,937,403 | 2/1976 | Lawson | 339/97 C |
| 3,980,376 | 9/1976 | Rosen | 339/75 MP |
| 3,980,377 | 9/1976 | Oxley | 339/176 MP |
| 4,118,094 | 10/1978 | Key | 339/75 MP |
| 4,221,448 | 9/1980 | Logerot et al. | 339/75 MP |
| 4,275,944 | 6/1981 | Sochor | 339/74 R |
| 4,443,049 | 4/1984 | De Pommery et al. | 339/75 |
| 4,449,775 | 5/1984 | De Pommery et al. | 339/75 |

FOREIGN PATENT DOCUMENTS

| | | | |
|---|---|---|---|
| 1465687 | 5/1969 | Fed. Rep. of Germany . | |
| 1391864 | 2/1965 | France . | |
| 2185914 | 1/1974 | France . | |
| 22981 | 9/1969 | Japan | 339/176 MP |
| 977982 | 12/1964 | United Kingdom . | |

*Primary Examiner*—John McQuade

[57] ABSTRACT

A holder for receiving cards with electronically stored data or printed circuit boards. The holder has guide means to receive the card. The holder is provided with a connector with contact springs for contacting connection strips located on the card. One end of each contact spring is clamped while the other is free to move and make contact with the connection strips. The contact springs include the parts formed by bending and shaped so as to minimize pressure and friction against the connection strips of the card.

10 Claims, 16 Drawing Figures

CARD HOLDER

BACKGROUND OF THE INVENTION

The invention relates to credit and other cards with electonically stored data which can be read and printed circuit boards, and more particular to a holder provided with guide means to receive such cards.

Automation in banking has led to electronic data processing of many banking functions. Automatic bank teller machines are now a common sight. Various banking transactions, including customer withdrawal, can be done at these machines by means of precoded cards such as credit cards.

There is now the possibility of providing on such a card a memory chip by means of which personal data can be stored. This data can be read when the card is inserted into a guide groove of a holder intended for the purpose and when connection strips on the card contact contact springs disposed in the holder. The connection strips are preferably in the form of edge contacts.

It is extremely important that the card should be usable many times without the edge contacts being damaged by the contact springs. Such damage occurs in existing cards because a certain contact pressure is necessary for reliable reading of the card. Consequently, friction occuring between the contact springs and connection strips, results in unacceptable wear.

SUMMARY OF THE INVENTION

The object of the invention is to provide a holder of the type described above which avoid the above problem.

This object is achieved according to the invention in that each contact spring has a first spring end part which is adjacent to the movable end of the contact spring, an intermediate spring part and a second clamped spring end part serving as connection terminal; said first contact spring part being disposed substantially perpendicular to the intermediate spring part, and said intermediate part being substantially perpendicular to the infeed plane of the holder; that the first spring part is spaced from the shifting plane of the connection strips; and that a stop element is located at the point where the first spring end part and the intermediate spring part join, said stop element extending from the plane of the first spring end part into the infeed plane of the holder. One of the advantages achieved by this arrangement is that during the build-up of the contact pressure, the contact point between contact spring and connection strip undergoes no relative displacement.

The contact spring parts and their respective stop elements are preferably bent from one piece. In an embodiment in which the contact spring is in one piece, the intermediate spring part continues past the first spring end part and, after successively bending back through 180 degrees and bending through 90 degrees, the intermediate spring part merges into the first.

In another embodiment the stop element is formed by at least one extension piece of the intermediate spring part continuing along the first spring end part.

As embodiment which is particularly suitable for adjustment of the contact spring is characterized in that the extension piece is bent in the direction of the first spring part along a bending line which runs substantially parallel to the center line of the intermediate spring part. Adjustment of the contact pressure takes place by setting the width of the extension piece or the angle thereof relative to the intermediate spring part.

According to another embodiment of the invention, the end of the first spring part is bent back through less than 180 degrees and can make contact with a connection strip of an inserted card.

According to yet another embodiment, the intermediate spring part, after successively bending back through 180 degrees and bending through 90 degrees, merges into the second spring end part which is parallel to the first spring part.

Since a card reader provided with the card holder is usually fitted on the outside of an apparatus, the contact springs cannot be soldered in customary fashion into a plate with printed wiring. An embodiment which solves this problem is characterized in that the second contact spring part is provided at the clamped end with forced-out points. When these points have been pushed through a ribbon cable, they are back against the ribbon cable. This procudes a reliable contact between contact spring and a conductor of the ribbon cable.

The abovementioned object to provide a holder which avoids the friction between the contact springs and connection strips is achieved according to a second aspect of the invention in that each contact spring has a first spring end part which is adjacent to the moveable end of the contact spring, an intermediate spring part bent into a U-shape and a second clamped spring end part serving as connection terminal, in which the one and the other legs of the U join the first and second spring end parts respectively, said first spring part being disposed substantially perpendicular to the intermediate spring part, and said intermediate part being substantially perpendicular to the infeed plane of the holder; that a stop element is located at the point where the first spring end part and the intermediate spring part join, said stop element extending from the plane of the first spring end part into the infeed plane of the holder; that in the rest condition, the legs of the intermediate spring part converge slightly to each other in the direction of their ends; that the first spring end parts extends slantingly past the shifting plane of the connection strips of the card; that a biasing rod having a substantially rectangular cross-section to be inserted and/or operated from outside is provided, said rod lying parallel to and between the stop elements and the bottom of the holder in the rest condition of the contact springs and when rotated by a fourth part of one revolution, the U-legs and so the first spring end parts are bent from the shifting plane of the connecting strips of the card, so that in the subsequent inserting of the card without contact pressure, said card abuts with its front edge against the stop elements of the contact springs, whereafter the biasing rod is newly rotated by a fourth of one revolution and then the contacting strips contact the contact points of the first end part of the springs.

An embodiment according to the second aspect of the invention is characterized in that one or more first spring end parts are pre-bent to the infeed plane of the card more as to the remaining first spring end parts, so that the contact points thereof make earlier respectively disconnect later the contact with the contacting strips of the card than the contact points of the said remaining end parts when the rod is rotated by a fourth of one revolution for making respectively disconnecting the contact.

A further embodiment is characterized in that the second spring end parts etxend in upright position from the other U-leg of the contact springs through the bottom of the connector and project parallel to each other out of the connector at the side facing from the insert side.

Yet a further embodiment of the invention is characterized in that the contact springs are separated from each other by insulating partitions accomodated in the connector.

Another embodiment of the invention is characterized in that the connector is provided with a non-conductive support located between the first spring end parts and the infeed plane of the holder and presenting a support face parallel to the holder infeed plane for supporting the said end parts in the rest position, that the said support has at its free end facing to the intermediate spring parts an inclined race for the first spring parts; and that the tip of said first spring end parts extends under an acute angle as to the support face.

BRIEF DESCRIPTION OF THE DRAWINGS

The invention will be explained further below with reference to the drawing. In the drawing.

FIG. *2a, 2b* , *2c* and *2d* illustrate various schematic embodiments of a contact spring according to the invention.

FIGS. *3a* and *3b* are, respectively, a plan view and a cross-section of an embodiment illustrating the contact between contact spring and a conductor of a ribbon cable.

Figure 4:
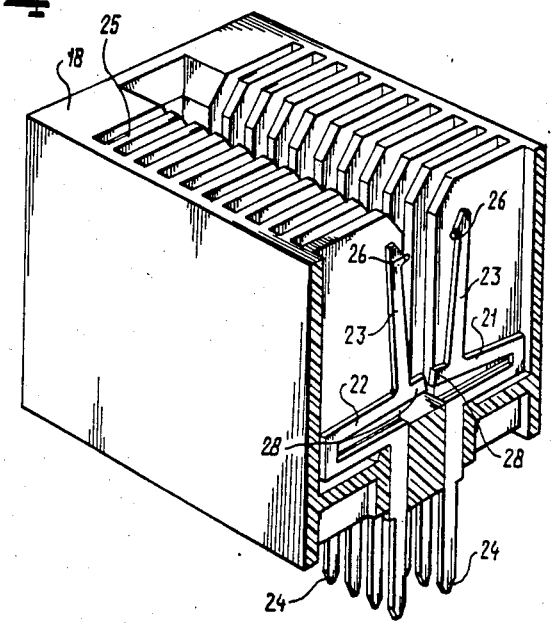

FIG. 4 is a perspective view of an embodiment of the invention for a printed circuit board.

Figure 5:
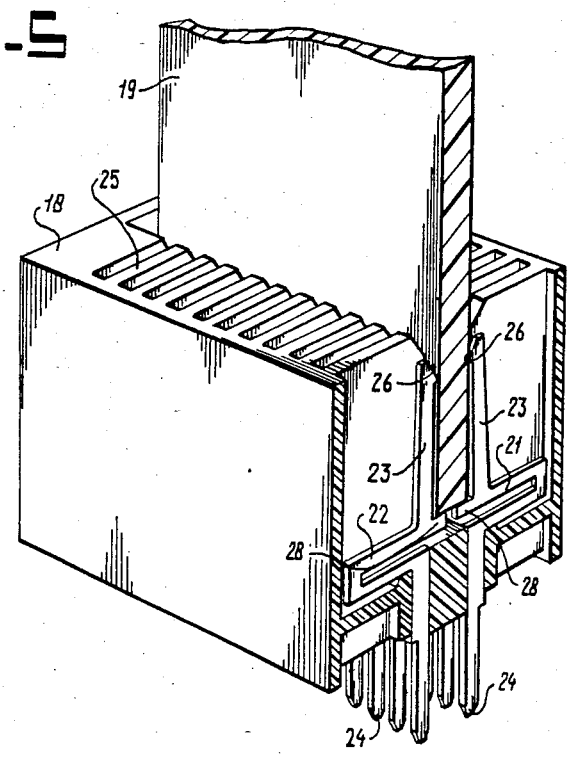
Figure 7:
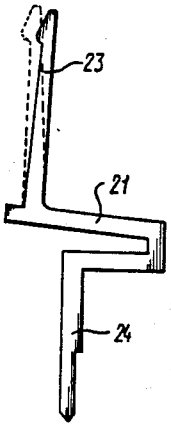
Figure 9:
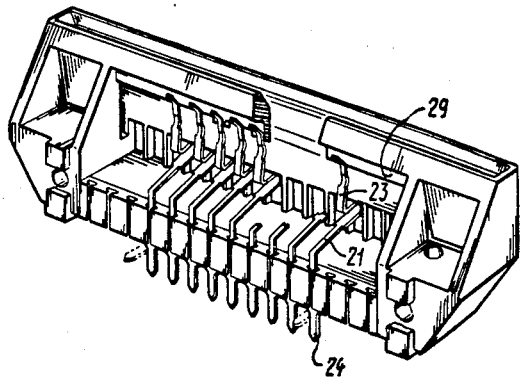

FIG. 5 shows a perspective view of the embodiment of FIG. 4 in which the printed circuit board is inserted;

FIGS. *6a* and *6b* respectively illustrate a cross-section of another embodiment of the invention having a contact spring in unbiased and biased condition, in which the printed circuit board is inserted;

FIG. 7 is a cross-section of one single contact spring being bent additionally;

FIG. *8a* and *8b* show some modifications of the contact points of a single contact spring;

FIG. 9 illustrates another embodiment of the invention; and

Figure 10:
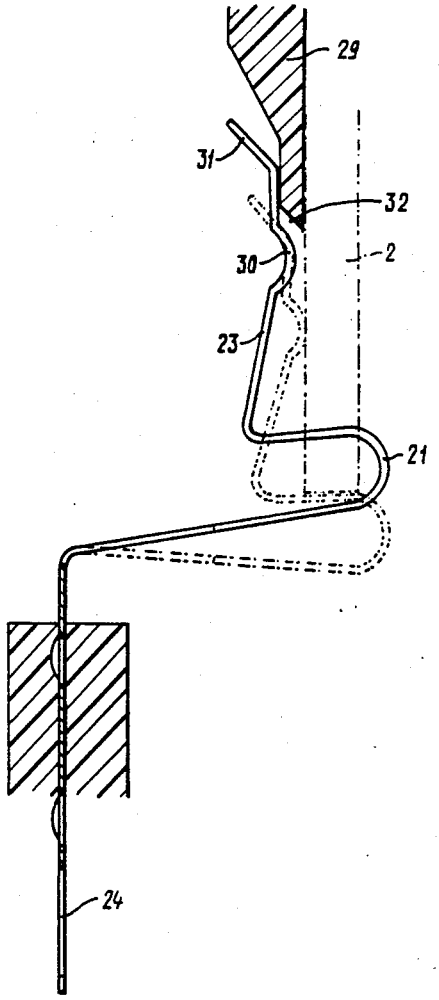

FIG. 10 is a detail of FIG. 9.

DESCRIPTION OF THE PREFERRED EMBODIMENTS

Figure 1:
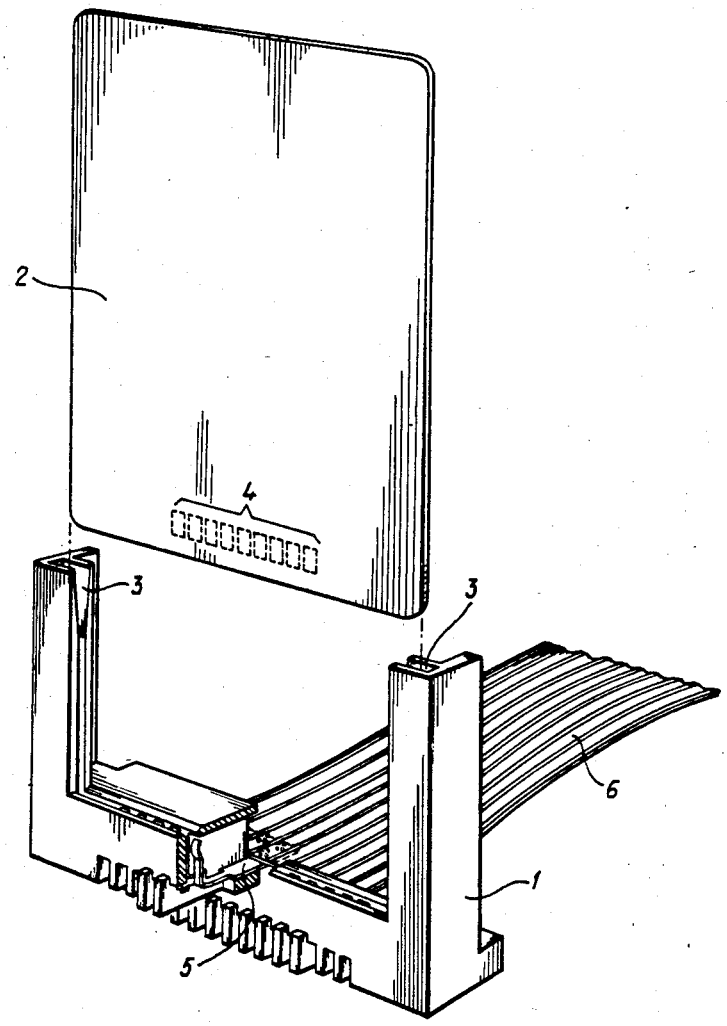
FIG. 1 is a perspective view showing a card reader holder according to the invention.

FIG. 1 illustrates a card reader holder 1, above which is a card 2 to be inserted. The card may be an identity or credit card or the like. On the card 2 are a number of connection strips 4 in the form of edge contacts, which are connected to a memory chip or other similar integrated circuit (not illustrated).

The card reader holder 1 is provided with guide grooves 3 for the card 2 to be inserted. On the underside of the card reader holder 1 there are a number of contact springs 5 which are clamped at one end in the holder. Through the removal of part of the holder, one of the contact springs 5 is clearly visible. The other end of the contact spring 5 is freely movable and will make contact with the edge contact 4 of the inserted card 2. The clamped end of the contact spring 4 is connected to a conductor of the ribbon cable 6, which in turn is connected to the reader device (not shown).

FIG. *2a* to *2d* show different embodiments of the contact spring 5. The contact springs consist of two parts 7 and 8 which are at right angles to each other. The first contact spring part 7 has a contact face 9 which comes to rest against an edge contact 4 of an inserted card 2 and makes contact with it. The second contact spring part 8 of the embodiments shown in FIGS. *2a, 2b* and *2c* is clamped in the holder. In the embodiment of FIG. *2d,* the contact spring can be clamped by means of a soldering connection pin 10. The contact springs of FIGS. *2a* and *2d* all have a stop element 11, which an inserted card comes up against. The stop element 11 in FIG. *2a* is formed by an extension piece 12 of the second contact spring part 8, which is bent back through 180 degrees and, after a bend of virtually 90 degrees, merges into the first contact spring part 7.

In the contact spring of FIG. *2c,* use is made of two extension pieces 13 of contact spring part 8. Extension pieces 13 run through on either side of the contact spring part 7. These extension pieces 13 serve as the stop element 11 for the card 2 to be inserted. Although two extension pieces 13 are shown here, one could do with one extension piece if necessary. Owing to the fact that two extension pieces 13 are used here, tilting of the contact spring part 7 in its plane is avoided.

The contact spring of FIG. *2b* has only one extension piece 14 as a stop element, which is bent along the bending line 15 in the direction of the contact spring part 7. The pressure of the contact face 9 against an edge contact of an inserted card can be adjusted by setting the dimension of the extension piece 14 in the direction of the contact spring part 7, or by setting the angle of the extension piece 14 relative to the contact spring part 8.

Such adjustment takes place in the embodiment according to FIG. *2a* by pinching in the stop element 11 or causing it to expand. Adjustment is also possible by bending the extension pieces 13 of the contact spring of FIG. *2c.* The embodiment of FIG. *2d* can be adjusted in the same manner as that of FIG. *2a.*

Since the contact springs consist of two parts 7 and 8, at right angles to each other with a stop element 11 near the transition point, when the card 2 is inserted to a particular depth its front edge will come up against the stop element. When the card 2 is inserted further, the clamped part 8 undergoes angular rotation. The other contact spring part 7 thereby undergoes a displacement and is pressed with increasing pressure against the edge contacts 4 of the card 2, without the contact point between edge contact and contact spring shifting in relation to the edge contact or contact spring face 9. The contact pressure will be determined dependent on the vertical displacement of the card and thus of the contact spring parts 7 and 8. On insertion, the card 2 is guided in the guide grooves 3 for this purpose, so that the card undergoes no horizontal displacement. It is clear that during insertion of the card 2 wear is restricted to a minimum through the fact that the abovementioned contact point undergoes no relative displacement when the contact pressure is being built up.

In order to make the whole unit insensitive to dust particles, openings are provided in the bottom of the guide holder, so that no accumulation of dust can occur.

Since the card reader holder is usually fitted on the outside of the card reader device, the contact springs cannot be soldered into a plate with printed wiring, as is usually the case. In this connection, flexible wiring in the form of a ribbon cable 6 is used.

Figure 2A:
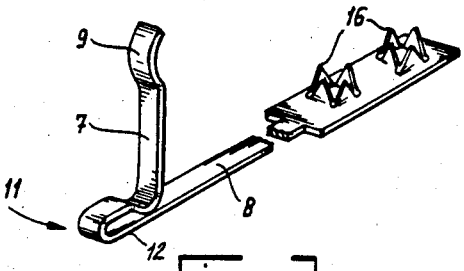
Figure 2B:
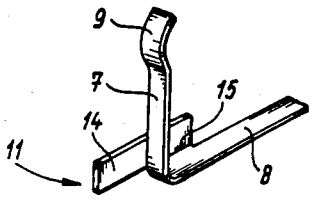
Figure 2C:
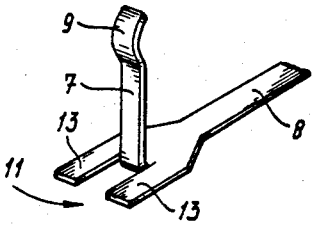

For the contact between a conductor 17 of the ribbon cable 6 and a contact spring, the clamped contact spring part 8 is provided on its end with forced-out points 16 such as shown in FIG. 2*a*. It can be seen from FIGS. 3*a* and 3*b* that this connection is produced by the sharp points 16 being pressed through the film of the ribbon cable and then being flanged back. The connection thereby obtained is produced at four points 16 simultaneously, through these four points partially cut through the signal track. An important part for the signal transmission is still present, particularly in the center of the shrink connection.

Figure 3A:
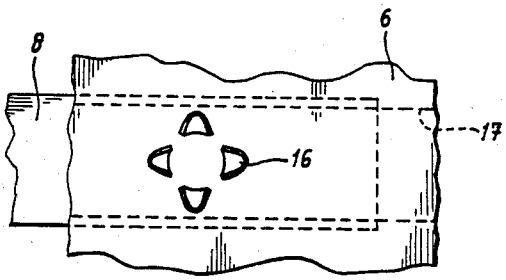
Figure 3B:
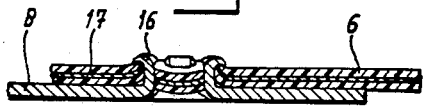

As can be seen from the cross-section of FIG. 3*a*, the displacement of the partially cut away film has caused the central part to bulge out and, with a force developed in the process, to lie against the inner side of the contact points. Compared with other shrink connections on ribbon cables or flexible films, the film is cut through by rigid material parts and is subsequently deformed in such a way that elastic action of the film on the metal parts is not possible anymore or inadequate.

Figure 2D:
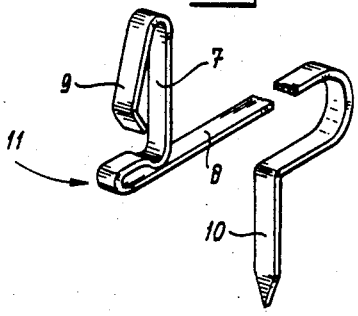

As explained earlier, the contact spring according to FIG. 2*d* is provided with a soldering pin 10. It should also be said that the shape of the contact spring according to FIG. 2*d* will be important if the contacts are to be in line with the card 2.

FIG. 4 shows a perspective view of a cut out edge connector, in which a number of parallel spring members are accomodated for engaging contact faces at the insert edge of a printed circuit board. Each contact member consists of two individual opposing contact springs 21 and 22. Each contact spring consists of an intermediate spring part bent in an U-shape, one first spring end part 23 extending in upright position from the one U-leg and a second spring end part 24 implemented as contact pin and extending from the other U-leg. The second spring end parts are clamped in any suitable way in the bottom of the housing 18 of the edge connector. They may project both in upstanding position and parallel to each other from the bottom and through the sidewalls in clamped condition out of the connector.

In the embodiments shown in FIGS. 4, 5 and 6 the advantage according to the invention is obtained that, in inserting the printed circuit board a relative movmement between contact points of the contact springs and contact faces of the printed circuit board does not occur. Thereby a wearless contacting is realized resulting in a rather unlimited long duration of life of the edge connector.

In the embodiment shown in FIGS. 4 and 5 the contact pressure is built up during inserting. In inserting the printed circuit board 19 its insert edge abuts against a fixed stop element provided by both of the rows of opposing stop lips 28 of the U-shaped intermediate spring partts of the contacts springs 21,22. By the subsequent continuous inserting the contact points 26 of the contact springs will engage the opposing contact faces of the printed circuit board and a contact will result. Thereby no or nearly no relative displacements between both spots occur. The printed circuit board is locked now by means of an external locking device and thereby, is kept in its place. By unlocking the printed circuit board this will be pushed away by a common spring force from the individual contact springs, so that the printed circuit board may be removed readily.

In the embodiment according to FIGS. 4 and 5 a small force is required during inserting the printed circuit board, because said printed circuit board should be pressed slightly against the spring force from the individual contact springs.

Figure 6A:
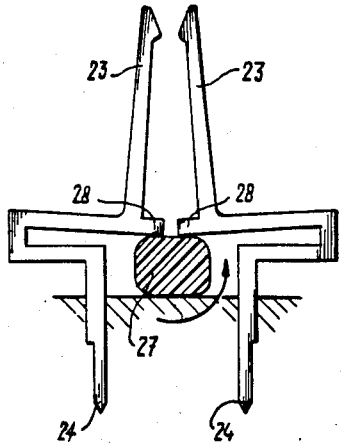
Figure 6B:
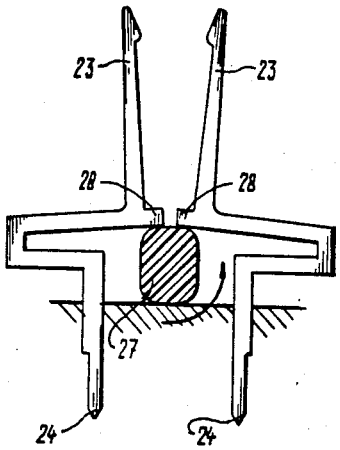

In the other embodiment, of which FIGS. 6*a* and 6*b* present a front view of an individual contact spring member, the inserting of the printed circuit board is realized without contact pressure or with zero force. The individual contact springs of each contact spring member are rebent such that the U-legs of the intermediate spring part of each contact converge in some extent to each other in unbiased condition and without inserted printed circuit board. A rod 27 to be inserted and/or operated from the outside has been received between e.g. the bottom of the housing of the edge connector and both of the stop lips of the one legs of the intermediate spring parts. By rotating the biasing rod 27 by a fourth of a revolution, as indicated in FIG. 6*b* both of the U-legs and consequently also both of the first spring end parts 23 of both of the contact springs are bent from each other. By the subsequent inserting of the insert edge of the printed circuit board it is not required to generate a force and the printed circuit board will ultimately rest against the row of both opposing stop lips. By rotating the biasing rod from the outside by a fourth of a revolution the contact points of both of the first spring end parts 23 will make contact to the contact faces of the printed circuit board without requriement of building up a contact force during inserting. By rotating the biasing rod by a fourth of a revolution for releasing the printed circuit board, said board may be removed from a connector without a further force.

The advantage of said second embodiment is that an additional locking of the printed circuit board is not required anymore. Furthermore, by the absence of the inserting force required otherwise, a higher number of contacts per connector may be employed, e.g. 2×200 contacts per connector having a mutual distance of 1.0 mm.

Similarly in this other embodiment one or more contact spring members as indicated in FIG. 7 may be prebent additionally so that the contact points thereof make earlier respectively disconnect later the contact with the contact faces of the printed circuit board (first make, last break) then the contact points of the remaining contact spring members. This feature is of great importance now as the components in the micro-electronic technique are sensitive for static electricity such that this must be discharged in time to earth.

It will be apparent that the shape of the contacts indicated in the drawings may be realized by both punching and folding.

Figure 8A:
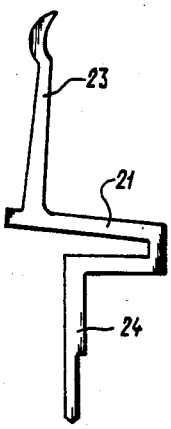
Figure 8B:
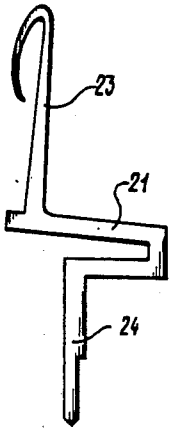

In FIGS. 8*a* and *b* some different possible embodiments of the contact points of the individual contact springs are illustrated.

FIG. 9 shows a further embodiment of a connector which may be used in e.g. a card reader holder or printed circuit board holder. In FIG. 10 a detail of said connector is shown in cross-section.

As in the abovementioned embodiment the connector is provided with a number of springs 21, 23, 24 for the connection with contact surfaces on a card of board to be inserted. In the rest position, i.e. in the condition of a not inserted card or board, the free ends 23 of the springs are supported by a support face of a support element 29. When the card is inserted, the intermediate part 21 of each spring is urged downwards and the free ends 23 of the springs slide from the support 29. Then the contacts 30 of the springs engage the corresponding connecting surfaces of the card.

In FIG. 10 the spring 21,23,24 is shown by a solid line in the rest position and by a dashed line in the operation condition.

In the rest position all of the free contact spring ends lie on the support face of the support 29 and may not be damaged by the memo/credit card or printed circuit board during its insertion. When the contact is displaced by inserting the card deeper, the spring ends leave the supporting face of the support 29. As in the operation condition, all of the springs engage with their contact 30 against the contacting surface of the card, they will be displaced with the card by retracting it and by means of the inclined spring tip 31 and the inclined race 32 the springs return into their initial position.

It should be understood that the invention is not limited to the embodiments described above and that modifications and additions are contemplated with the scope of the invention.

We claim:

1. A holder for receiving a card with electronically stored data or a printed circuit board comprising:

guide means forming part of said holder and an connector being provided with a plurality of contact springs for contacting connection strips disposed on said card or board, one end of each said contact spring being clamped while the other end is freely movable and makes contact with one of the connection strips when the card or board is inserted;

each said contact spring having a first spring end part which is adjacent to the movable end of the contact spring, an intermediate spring part bent into a U-shape and a second clamped spring end part serving as connection terminal, in which the one and the other legs of the U join the first and second spring end parts respectively, said first spring part being disposed substantially perpendicular to the intermediate spring part, and said intermediate part being substantialy perpendicular to the infeed plane of the holder;

a stop element located at the point where the first spring end part and the intermediate spring part join, said stop element extending from the plane of the first spring end part into the infeed plane of the holder;

whereby in the rest condition, the legs of the intermediate spring part converge slightly to each other in the direction of their ends;

said first spring end part extending slanting past the infeed path of the connection strips of the card or board; and a biasing rod having a substantially rectangular cross-section to be inserted and/or operated from outside, said rod lying parallel to and between the stop elements and the bottom of the holder in the rest condition of the contact springs and when rotated by a fourth of one revolution, the U-legs and the first spring end parts are bent from the infeed path of the connecting strips, so that in the subsequent inserting of the card or board without contact pressure, said card or board abuts with its front edge against the stop elements of the contact springs, whereafter the biasing rod is newly rotated by a fourth of one revolution and then the contacting strips contact the contact points of the first end part of the springs.

2. A holder according to claim 1, wherein each of the contact springs and their respective stop elements are formed integrally from a single blank.

3. A holder according to claim 2, wherein each said contact spring is formed so that the intermediate spring part extends past the first spring end part and, is successively bent back through 180 degrees and then through 90 degrees merging thereby into the first spring end part.

4. A holder according to claim 2, wherein the stop element is formed by at least one extension piece of the intermediate spring part extending along the first spring end part.

5. A holder according to claim 4, wherein the extension piece is bent in the direction of the first spring end part along a bending line which runs substantially parallel to the center line of the intermediate spring part.

6. A holder according to claim 1 wherein the end of the first spring part is further bent back through less than 180 degrees and makes contact with a connection strip of an inserted card.

7. A holder according to claim 2, wherein the intermediate spring part is successively bent back through 180 degrees and then through 90 degrees and merges into the second spring end part which is parallel to the first spring part.

8. A holder according to claim 1 wherein at least one of said first spring end parts is pre-bent to the infeed plane of the card more than the remaining first spring end parts, so that the contact point of said at least one first spring end part will disconnect later the contact with the contacting strips of the card than the contact points of the said remaining end parts when the rod is rotated by a fourth of one revolution.

9. A holder according to claim 1 or 8, wherein the second spring end parts extend in upright position from the other U-leg of the contact springs through the bottom of the connector and project parallel to each other out of the connector at the side facing from the insert side.

10. A holder according to claim 1 wherein the contact springs are separated from each other by insulating partitions accommodated in the connector.

* * * * *